US006134913A

United States Patent [19]

Gentile

[11] Patent Number: 6,134,913

[45] Date of Patent: Oct. 24, 2000

[54] METHOD AND APPARATUS FOR COMPRESSION OF A POLARIZED GAS

[75] Inventor: Thomas R. Gentile, Kensington, Md.

[73] Assignee: The United States of America, as represented by the Secretary of Commerce, Washington, D.C.

[21] Appl. No.: 09/173,170

[22] Filed: Oct. 15, 1998

Related U.S. Application Data

[60] Provisional application No. 60/062,260, Oct. 17, 1997.

[51] Int. Cl.[7] ..... F25J 1/00

[52] U.S. Cl. ..... 62/637; 62/3.1; 62/51.1

[58] Field of Search ..... 62/3.1, 51.1, 637

[56] References Cited

U.S. PATENT DOCUMENTS

| | | | |
|---|---|---|---|
| 4,755,201 | 7/1988 | Eschwey et al. | 62/637 |
| 5,113,661 | 5/1992 | Deeks | 62/3.1 |
| 5,209,068 | 5/1993 | Saji et al. | 62/3.1 |

*Primary Examiner*—Ronald Capossela
*Attorney, Agent, or Firm*—Davis & Kendall

[57] ABSTRACT

The invention comprises a new and unique 3He gas polarization process. In addition, it provides for an improved diaphragm pump configuration. This arrangement allows the 3He gas and 3He–4He gas mixture to be polarized and compressed to a pressure in the range of one bar and placed into a glass storage cell without significant loss of polarization.

14 Claims, 2 Drawing Sheets

METHOD AND APPARATUS FOR COMPRESSION OF A POLARIZED GAS

This invention is the subject of a provisional application that was filed on Oct. 17, 1997 and assigned document number 60/062,260.

FIELD OF INVENTION

The invention relates to the compression of polarized gas. More specifically, to an improved method and apparatus for the compression of polarized helium for use in medical applications of Magnetic Resonance Imaging (MRI) requiring a compression pressure in the one bar or higher range.

BACKGROUND OF INVENTION

Polarized gas is defined as a gas in which the nuclear spins are preferentially aligned with an external magnetic field. These gases are used in a variety of scientific fields, most recently in MRI medical applications. The MRI application of the polarized gas requires a pressure in the one bar or higher range. One method of producing such a polarized gas is by metastability-exchange optical pumping of a helium gas. This can only be accomplished at pressures of a few millibar necessitating compression of the gas without too great a loss of polarization.

Prior compression techniques and apparatus used in the polarization of gases have either been extremely costly, or have caused the polarized gas to suffer a great loss in polarization. In addition to being costly, the apparatus heretofore have been bulky and complex. For example, R. Surkau at al. in *Realization of a Broad Band Neutron Spin Filter with Compressed Gas,* published in Nuclear Instruments and Methods in Physics Research A 384, (1997), a method and apparatus for the compression of a helium gas. This method requires the use of a piston compressor constructed of titanium in order to avoid depolarization of the helium gas during compression. Moreover, the apparatus as described because of the physical size of the components is several cubic meters in size.

The prior art discusses in a thesis by Thomas Prokscha, University of Mainz, Germany, October of 1991 the use of a diaphragm pump in the compression process but rejects the idea in that they were primarily built out of magnetic material such as high grade steel. The electric motor will produce an non-homogenous magnetic field, and the diaphragm pump tested was considered to be too permeable to the ambient atmosphere.

A recent example of polarization of noble gases is U.S. Pat. No. 5,642,625, issued to Cates, Jr. et. al, it discloses an apparatus for hyperpolarization of noble gases and storage techniques of the gases.

What is needed but not provided in the prior art is an improved method of polarization of a helium gas and an apparatus for the compression of the helium gas with a reasonably high preservation of the polarization of the gas. Additionally, it would also be helpful to provide such features in a compact, inexpensive, and simple design. Finally, it would be helpful to provide such a mechanism which facilitates compression of the gas to 1 bar or greater.

SUMMARY OF THE INVENTION

The inventor has overcome the problems remaining from the prior art by devising a method of compressing a polarized helium three (3He) gas or polarized helium three-helium four (3He–4He) mixture to pressures of about 1 bar or higher. The improved method and apparatus does not result in the excessive depolarization of the helium gas. Further, it does not require that the compressor be constructed of titanium or some other costly material.

The advantages of the present invention are achieved by the use of an optical pumping cell, a surrounding magnetic field and an improved diaphragm pump. The diaphragm pump using annealed type 316 stainless steel as a component to avoid any depolarization due to magnetic field inhomogeneity, and a cryogenic storage cell used to increase the density of the 3He gas.

It is then an object of the invention to provide a method of polarizing a 3He gas.

It is a further object of the present invention to provide a diaphragm pump for the compression of 3He gas.

It is a further object of the present invention to provide such an method and apparatus where the 3He gas is polarized and compressed to 1 bar or greater.

It is also an object of this invention to compress a polarized mixture of 3He and 4He gas.

It is a further object of the present invention to provide a compact, and less costly method of polarizing 3He gas for applications requiring a gas pressure in the one bar or higher range.

Other features and advantages of the present invention will be apparent from the following description in which the preferred embodiments have been set forth in conjunction with the accompanying drawings

BRIEF DESCRIPTION OF THE DRAWINGS

In describing the preferred embodiments of the invention reference will be made to the series of figures and drawings briefly described below.

There may be additional structures described in the foregoing application which are not depicted on one of the described drawings. In the event such a structure is described but not depicted in a drawing, the absence of such a drawing should not be considered as an omission of such design from the specification.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Figure 1:
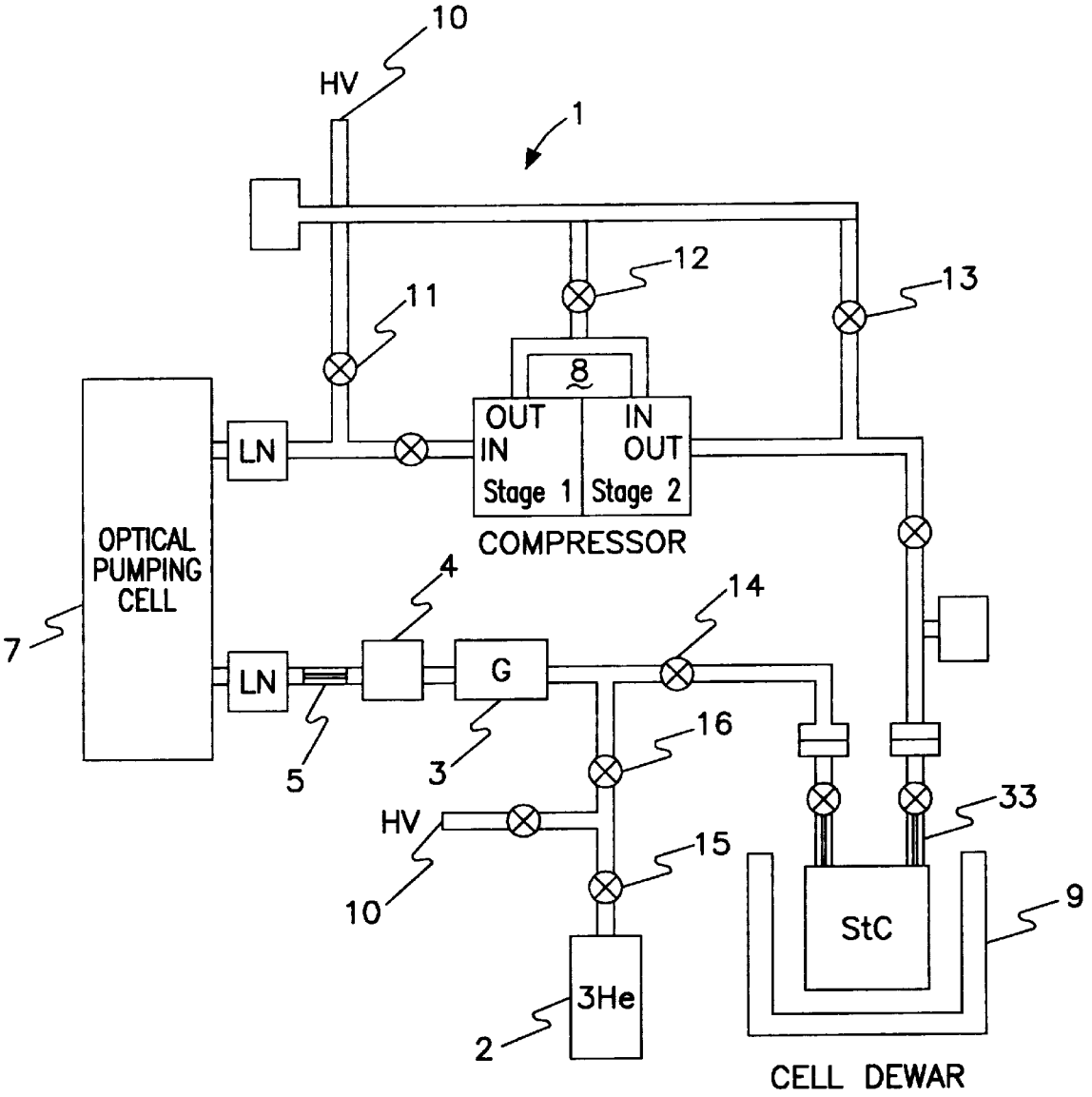
FIG. 1 depicts schematic diagram of the gas polarization system.

The invention comprises a new and unique 3He gas polarization process. In addition, it provides for an improved diaphragm pump configuration. This arrangement allows the helium gas to be polarized and compressed to at least one bar into a glass storage cell without significant loss of polarization. Referring to the schematic of FIG. 1, the gas polarization system (1) comprises a 3He or 3He–4He mixture gas supply (2), a Getter (3) and metering valve (4) connected to a flow restricting capillary (5). An optical pumping cell (7)

is connected to two stage compressor (8), which allows a compressed flow to a detachable storage cell (9). The polarized gas is transported through glass tubing and glass valves to provide a clean, non-depolarizing material for the flow of the polarized gas.

In operation, magnetic field gradients are avoided by establishing a small holding magnetic field. This can be done using Helmholtz coils (not shown). The polarization system (1) is first evacuated through High Vacuum (HV) points (10). Valves (11–14) are closed and the 3He supply valve (15) is opened. The flow rate is controlled by the configuration of the gas regulator (16), metering valve (4), and the flow restricting capillary (5). A typical flow rate and pressure is 0.1 mbar−1/sec at one bar outlet pressure. The supply valve (15) is opened and the 3He gas flows through the regulator (16) and enters the Getter (3). The Getter (3) cleans the 3He gas. It then passes through the metering valve (4) and capillary (5) which further restrict the flow rate as it enters the optical pumping cell (7). Prior to entering the optical pumping cell (7) the 3He gas enters a U-shaped tube immersed in liquid nitrogen (6*a*) where the gas is cooled before being introduced into the optical pumping cell (7). The liquid nitrogen surrounding the U-tubes (6*a*) acts as a cleaner to help evacuated water molecules and other impurities. A weak electrical discharge is maintained in the optical pumping cell (7). This produces the required metastable density for laser optical pumping. The light supplied at a wavelength of 1083 nm is provided by a laser (not shown). As the gas is polarized in the optical pumping cell (7) it exits into another U-tube immersed in liquid nitrogen (6*b*). The polarized gas then passes to a two stage compressor (8).

Figure 2:
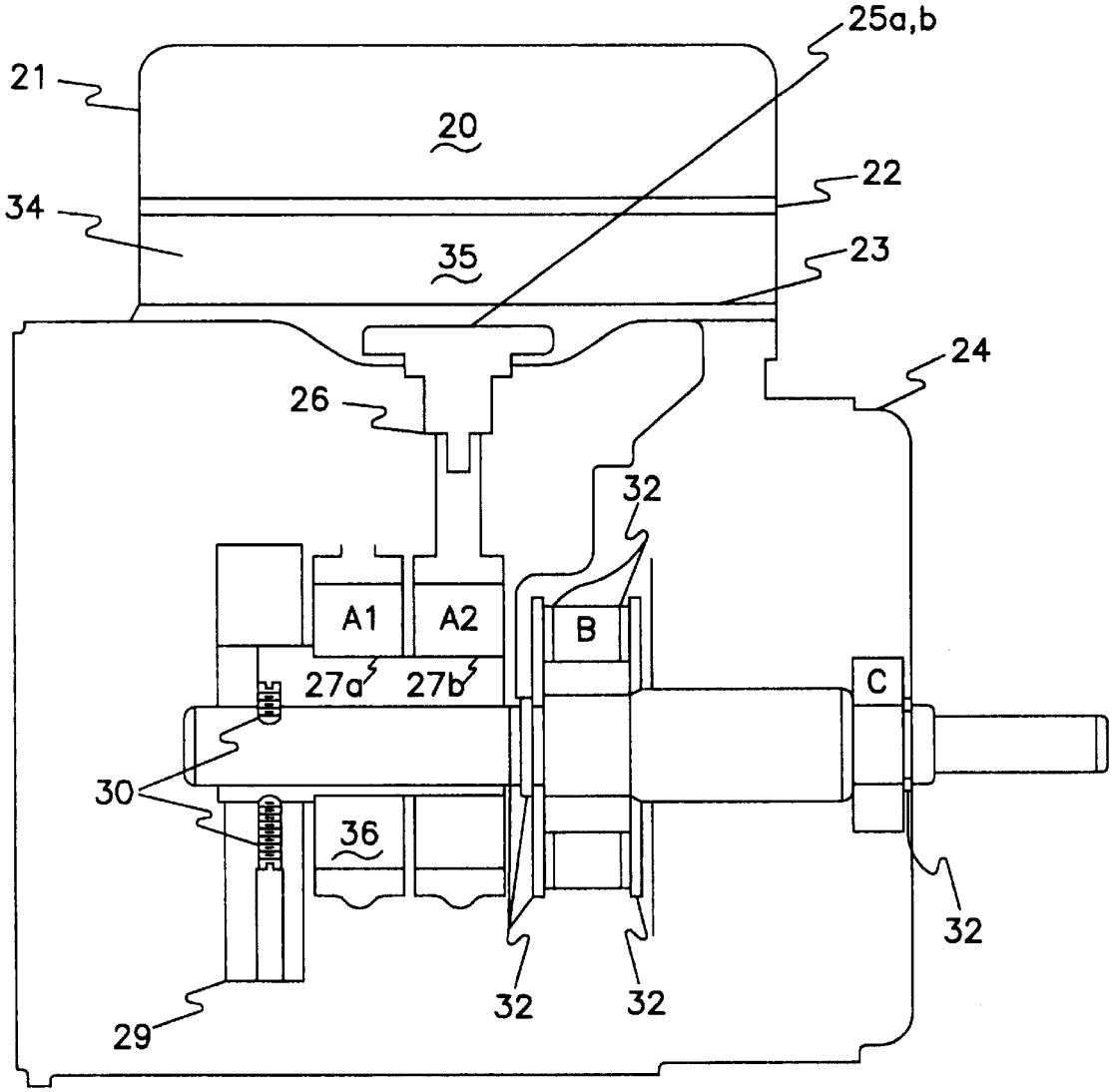
FIG. 2 depicts an embodiment of the improved diaphragm compressor.

As shown in FIG. 2, the two stage compressor (8) is a modified diaphragm pump (20) having essentially two aluminum head assemblies (21*a* and 21*b*). As shown, the head assembly (21*a*) includes a viton valve plate (22), and a Teflon coated neoprene diaphragm (23) attached to the pump body (24). The valve plate (22) is located in the cylinder head (21). An aluminum intermediate plate (35) is positioned above the diaphragm (23) creating a gas compression area (34). Aluminum, Teflon, and viton do not contain magnetic elements which depolarized the gas. However, successful preservation requires that the drive train of the pump is sufficiently non-magnetic so that the homogeneous magnetic field is not distorted. This accomplished by incorporating type 316 stainless steel for key components. Stainless steel studs (25*a*) is deposed in the pump body and attached to the diaphragm (23). Spacer washers (26) made of brass are attached to the bottom end of the stainless steel studs (25*a* ) and in communication with stainless steel bearing (27*a*).

The bearings (27*a* and 27*b*) are connected to a shaft (28) having two ends. One end is attached to a motor (not shown, in the preferred embodiment the motor is located outside the Helmholtz coils), and the other end has a counterweight (29) attached to a stainless steel shaft (28) by stainless steel set screws (30). The bearings (27*a* and 27*b*) are configured so that as the drive shaft (28) rotates they cause the stainless steel studs (25*a*) move in a reciprocating motion. An eccentric (36) is off-centered causing the bearings (27*a* and 27*b*) to push the stainless steel studs (25*a*) in an uneven reciprocating motion. This reciprocating motion causes the diaphragm (23) to compress the polarized gas within the gas compression area (34) A stainless steel bearing (31) is positioned at mid-point along the shaft (25) and adapted with two brass retaining rings (32*a*). Four berriliyum-copper retaining rings space an additional bearing (27*c*). The diaphragm pump (20) is essential in that it must elevate the 3He gas pressure to the one bar range.

Preventing depolarization at this stage is critical. The use of commercial compressors are not feasible in that they are constructed of high grade steel or some other ferrous metal, which generate strong magnetic field gradients thereby causing a relaxing effect on polarized gases. As a result, the use of stainless steel in this application is novel in that annealed type 316 stainless steel is almost completely non-magnetic.

The polarized gas exits the diaphragm pump (20) and passes through the capillary tubes (33) into the detachable storage cell (9). The detachable storage cell (9) is located in a cryogenic bath (liquid nitrogen). The cryogenic bath allows the gas density to increase by a factor of 300/77, according to the ideal gas law. Once the cell temperature rises to room temperature the pressure increases by the same factor.

Further modification and variation can be made to the disclosed embodiments without departing from the subject and spirit of the invention as defined in the following claims. Such modifications and variations, as included within the scope of these claims, are meant to be considered part of the invention as described.

What is claimed:

1. A method of polarizing and compressing a gas comprising the steps of:

generating a holding magnetic field;

introducing a gas into the holding magnetic field;

cleaning the gas and regulating the gas flow;

cooling the gas;

polarizing and recooling the gas;

compressing the gas by using a diaphragm pump; and storing the gas in a glass cell submerged in a cryogenic bath.

2. A method of polarizing and compressing a gas as recited in claim 1 wherein said step of generating a holding magnetic field further comprises the use of Helmholtz coils.

3. A method of polarizing and compressing a gas as recited in claim 2 wherein said step of cleaning the gas and regulating the flow consists of a using a Getter to clean the gas, and a metering valve and capillary tubes to regulate the flow of the gas.

4. A method of polarizing and compressing a gas as recited in claim 3 wherein said step of cooling the gas consists of passing the gas through a U-shaped tube immersed in liquid nitrogen whereby the liquid nitrogen further cleans the gas by solidifying any impurities.

5. A method of polarizing and compressing a gas as recited in claim 4 wherein said step of polarizing the gas and recooling consists of flowing the gas through an optical pumping cell that induces a weak electrical discharge and optically pumping the gas with light at a wavelength of 1083 NM and flowing the gas through a second U-shaped tube immersed in liquid nitrogen.

6. A method of polarizing and compressing a gas as recited in claim 5 wherein said step of compressing the gas by using a diaphragm pump comprises first and second cylinder head assemblies including first and second cylinder heads, and first and second valve plates;

a compressor body attached to said first and second cylinder heads;

a drive train deposed in said compressor body;

means for rotating attached to said drive train whereby when said means for rotating is engaged said means for rotating causes said drive train to rotate;

said drive train including a drive shaft, said drive shaft having a counterweight attached at one end of said drive shaft and being deposed in said compressor body and said other end of said drive shaft passing through said compressor body and being connected to said means for rotating;

first and second diaphragm positioned juxtaposed to said first and second cylinder heads and connected to said compressor body;

first and second stainless steel bearings attached to said drive shaft and located between said counterweight and said means for rotating; and first and second stainless steel studs attached at one end to said first and second diaphragms respectively and said other ends extending into said compressor body, and said first and second stainless steel studs are in contact with said first and second stainless steel bearings respectively.

7. The method as recited in claim 6 wherein said diaphragm pump further comprises a stainless steel set screw which attaches said counter weight to said drive shaft.

8. The method as recited in claim 7 wherein said means for rotating is an electric motor located outside said holding magnetic field.

9. The method as recited in claim 8 wherein said first and second stainless steel bearings are configured so as the drive shaft rotates said first and second stainless steel bearings impart a reciprocating motion on said first and second stainless steel studs.

10. The method as recited in claim 9 wherein the first and second stainless steel studs further comprise brass spacers attached to said other end of said first and second stainless steel studs.

11. The method as recited in claim 10 wherein said first and second valve plates are made of viton and are positioned within the first and second cylinder heads and above said first and second diaphragms creating first and second gas compression areas.

12. The method as recited in claim 11 wherein said first and second diaphragms are made of a Teflon coated neoprene.

13. The method as recited in claim 12 wherein step of storing said polarized gas further comprises allowing the gas to pass a restricting capillary into a glass cell submerged in a liquid nitrogen bath and thereby increasing the density of the gas.

14. The method as recited in claim 13 wherein said gas consisting of the group 3He, and 3He–4He gas mixture.

* * * * *